US005860503A

United States Patent [19]

Hanserud et al.

[11] Patent Number: 5,860,503

[45] Date of Patent: Jan. 19, 1999

[54] REVERSE VENDING APPARATUS

[75] Inventors: Terje Hanserud, Hvalstad; Kristian Holmen, Asker; Andreas Nordbryhn, Oslo, all of Norway

[73] Assignee: Tomra Systems A/S, Asker, Norway

[21] Appl. No.: 811,325

[22] Filed: Mar. 4, 1997

[30] Foreign Application Priority Data

Mar. 11, 1996 [NO] Norway ..... 960992

[51] Int. Cl.[6] ..... G07F 7/06

[52] U.S. Cl. ..... 194/213; 209/583

[58] Field of Search ..... 194/208, 209, 194/212, 213; 209/583, 930

[56] References Cited

U.S. PATENT DOCUMENTS

| | | | |
|---|---|---|---|
| 4,784,251 | 11/1988 | DeWoolfson et al. | 194/209 |
| 5,161,661 | 11/1992 | Hammond | 194/209 |
| 5,355,987 | 10/1994 | DeWoolfson et al. | 194/209 |
| 5,361,913 | 11/1994 | Melchionna | 194/209 X |

FOREIGN PATENT DOCUMENTS

| | | |
|---|---|---|
| 008182 | 9/1983 | European Pat. Off. . |
| 469496 | of 1983 | Sweden . |

*Primary Examiner*—F. J. Bartuska
*Attorney, Agent, or Firm*—Rodman & Rodman

[57] ABSTRACT

A reverse vending machine for empty cans, wherein a can (21) which is delivered by a machine user is inspected in a first section (1) of the machine with regard to special characteristics, where a non-accepted can is returned to the machine user, whilst an accepted can is fed to a second section (7) for discharge into a receptacle, optionally via a compactor or shredder (17). The first section (1) consists of a first can guide having a first end (1') for can insertion, a second end (1") for can discharge, and a partially open central section (1'"). At the first end there is provided a first metal detector (2), and at the second end there is provided a second metal detector (3). An optical reader (4) is provided at a radial distance from the central portion and has its sensing field covering at least a part of the central portion, the reader reading characteristics of the can, such as a bar code applied thereon. Impelling devices (5, 6, M1, M2) are provided at the central section in order to urge a can (21) in a first direction through the first can guide and out via the second end, or return a non-accepted can (21) to the machine user in a second, opposite direction via the first end. A control unit (19) is connected to the metal detectors (2, 3), the optical reader (4), and the impelling means (M1, M2), the control unit (19) being designed to determine whether collected data indicate that: the characteristics are readable and the can is acceptable, or the characteristics are readable, but the can is not acceptable, or the characteristics are not readable and the can is not acceptable. As a consequence of such indication the control unit (19) is designed to actuate the impelling devices (5, 6, M1, M2) to move the can in one direction or the other. The second section (7) is equipped with a blocking body (14) to prevent articles other than cans accepted by the control unit (19) from being transported from the first section (1) to the second section (2).

10 Claims, 4 Drawing Sheets

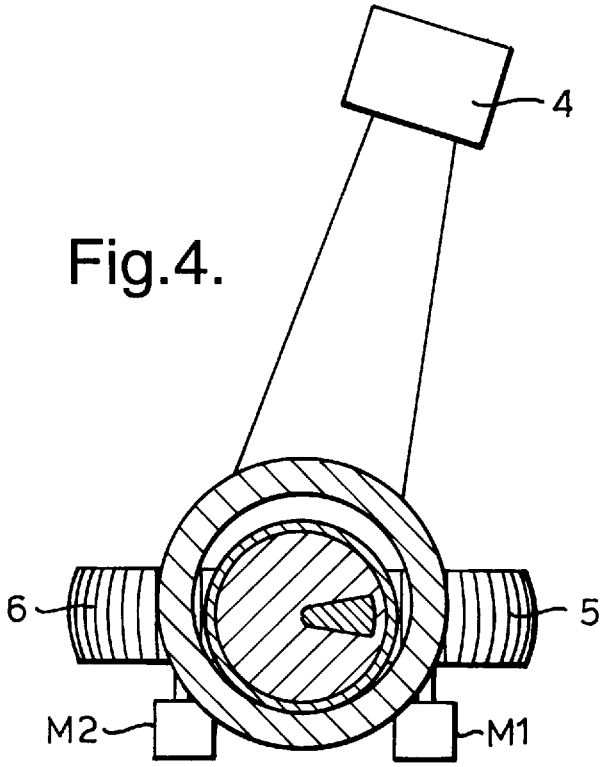
Fig.4.
Fig.5.
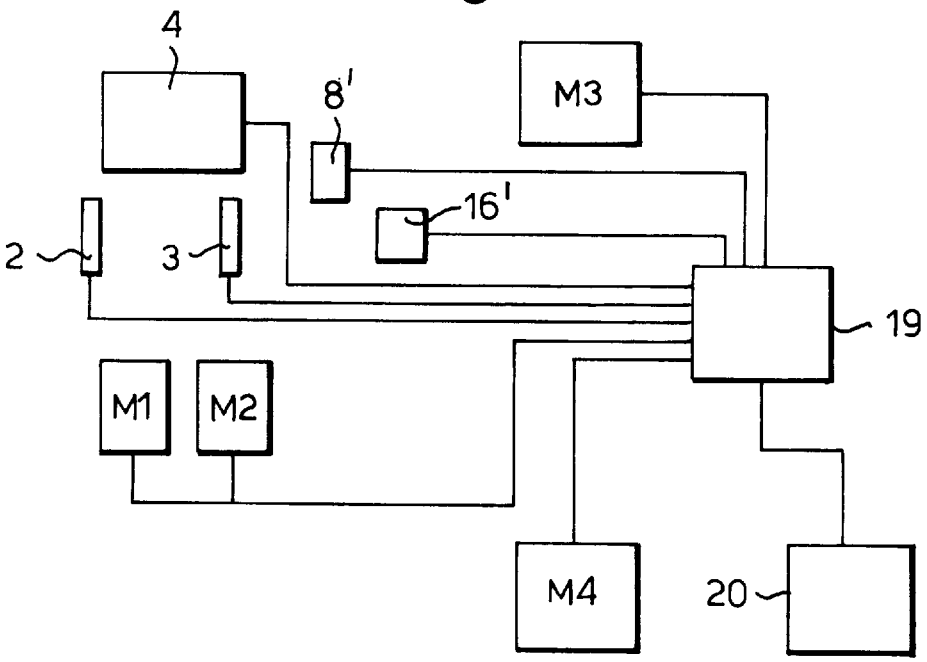

REVERSE VENDING APPARATUS

The present invention relates to a reverse vending apparatus for empty cans as disclosed in the preamble of claim 1 below.

Reverse vending machines for empty cans are previously known where the can is placed in a cradle and weighed to detect whether the can is within acceptable limits of weight, whilst characteristics of the can, e.g., the length thereof, can be measured. Cans of metals other than aluminium will normally be rejected and returned to the user of the machine. The same is true of aluminium cans which possibly contain foreign bodies.

The solution according to the prior art is to some extent technically complex and there is the possibility of the machine user perhaps stretching an arm inside the insertion opening in a possible attempt to retrieve an accepted can before it is conducted to compaction.

With the purpose of finding a technical solution whose primary object is to simplify not least the detection part of a reverse vending machine of this kind, an apparatus is proposed according to the invention which is characterised by the features disclosed in claim 1.

Additional embodiments of the apparatus according to the invention are apparent from the patent claims.

FIG. 4 shows details of a first section of the machine for detection purposes.

FIG. 5 shows a generalised circuit diagram for the apparatus according to the invention.

Figure 1:
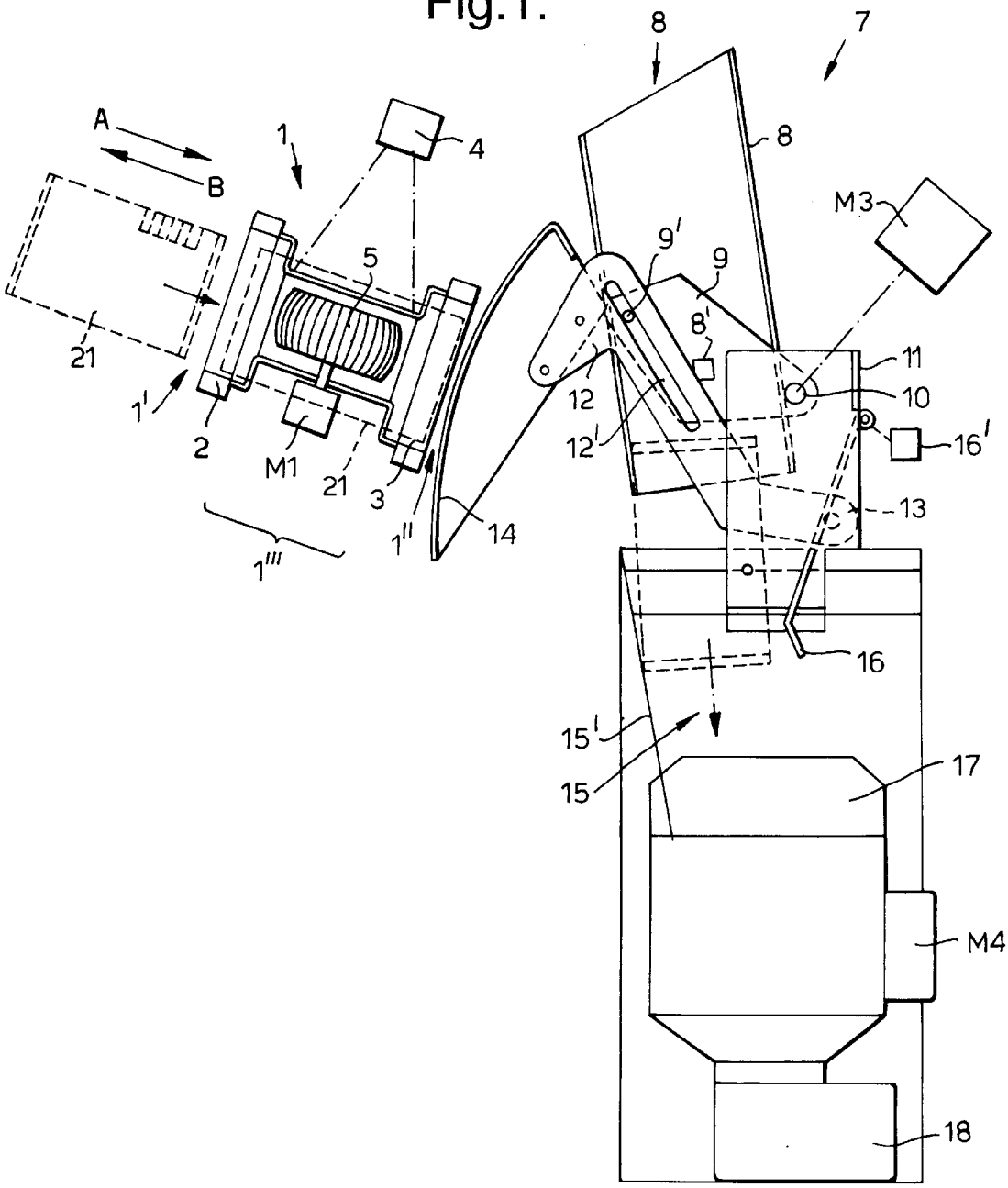
FIG. 1 shows the apparatus according to the invention in a typical can discharge phase and ready for the insertion of a new can.

The present apparatus consists of a first section 1 where special characteristics of the can 21 inserted by the machine user are to be inspected. An accepted can will then be fed to a second section 7 and then to a receptacle means, optionally via a compactor. If the can is not accepted during the inspection in the first section, the intention is that the can is returned to the machine user.

According to the invention, the first section 1 consists of a first can guide having a first end for insertion of a can, a second end for discharge of a can and a partially open central portion. A first metal detector 2 is provided at the first end of the first can guide and a second metal detector 3 at the second end. The metal detectors are preferably of the type which surrounds the can guide. However, other suitable types of metal detectors are also conceivable per se.

An optical reader 4 is positioned at a radial distance from the central portion of the first section and the sensing field of the reader covers at least a part of said central portion. The reader 4 is designed to read characteristics of the can, such as preferably a bar code applied thereon which identifies the can uniquely.

Figure 2:
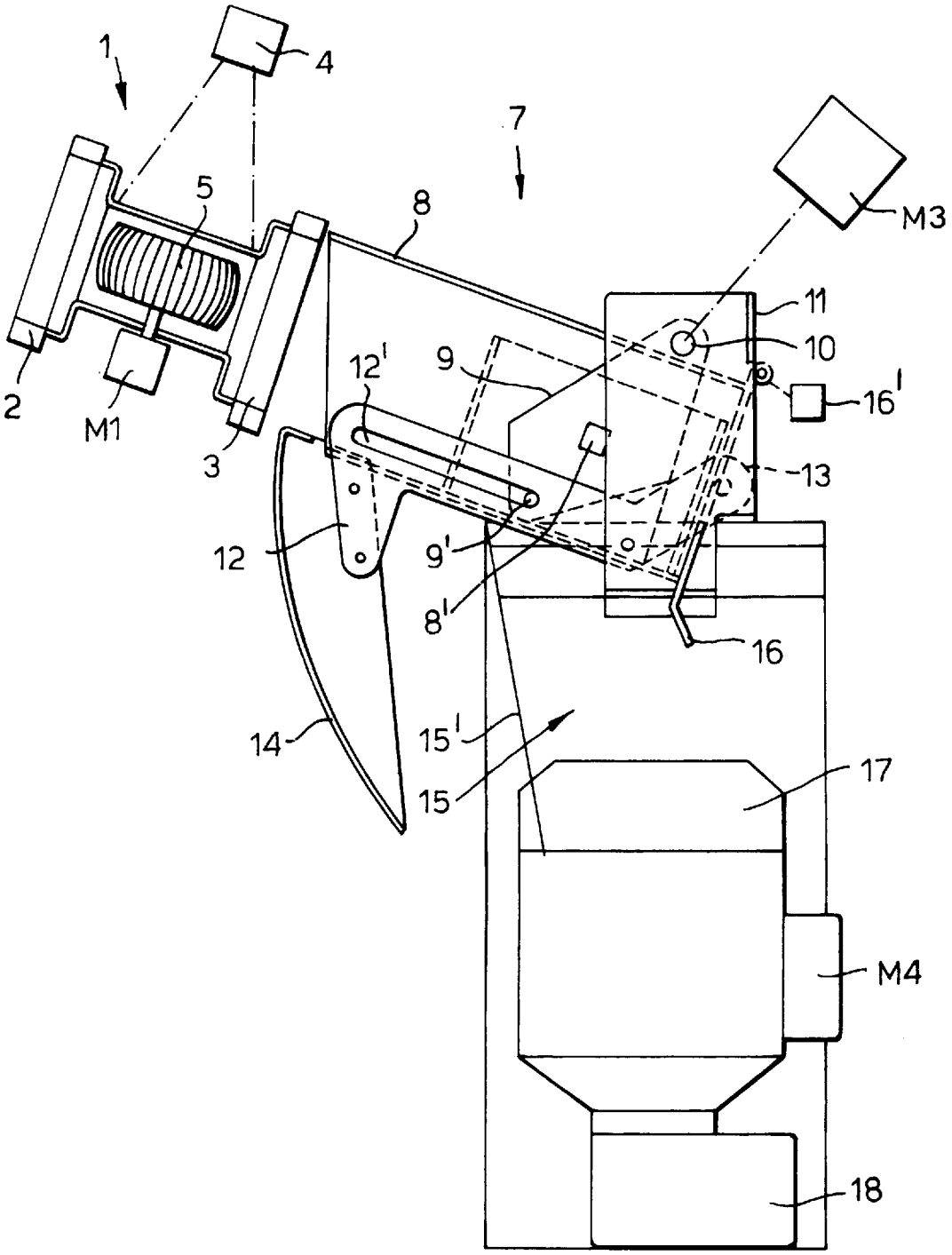
FIG. 2 shows the apparatus according to the invention in a typical can transfer phase.
Figure 3:
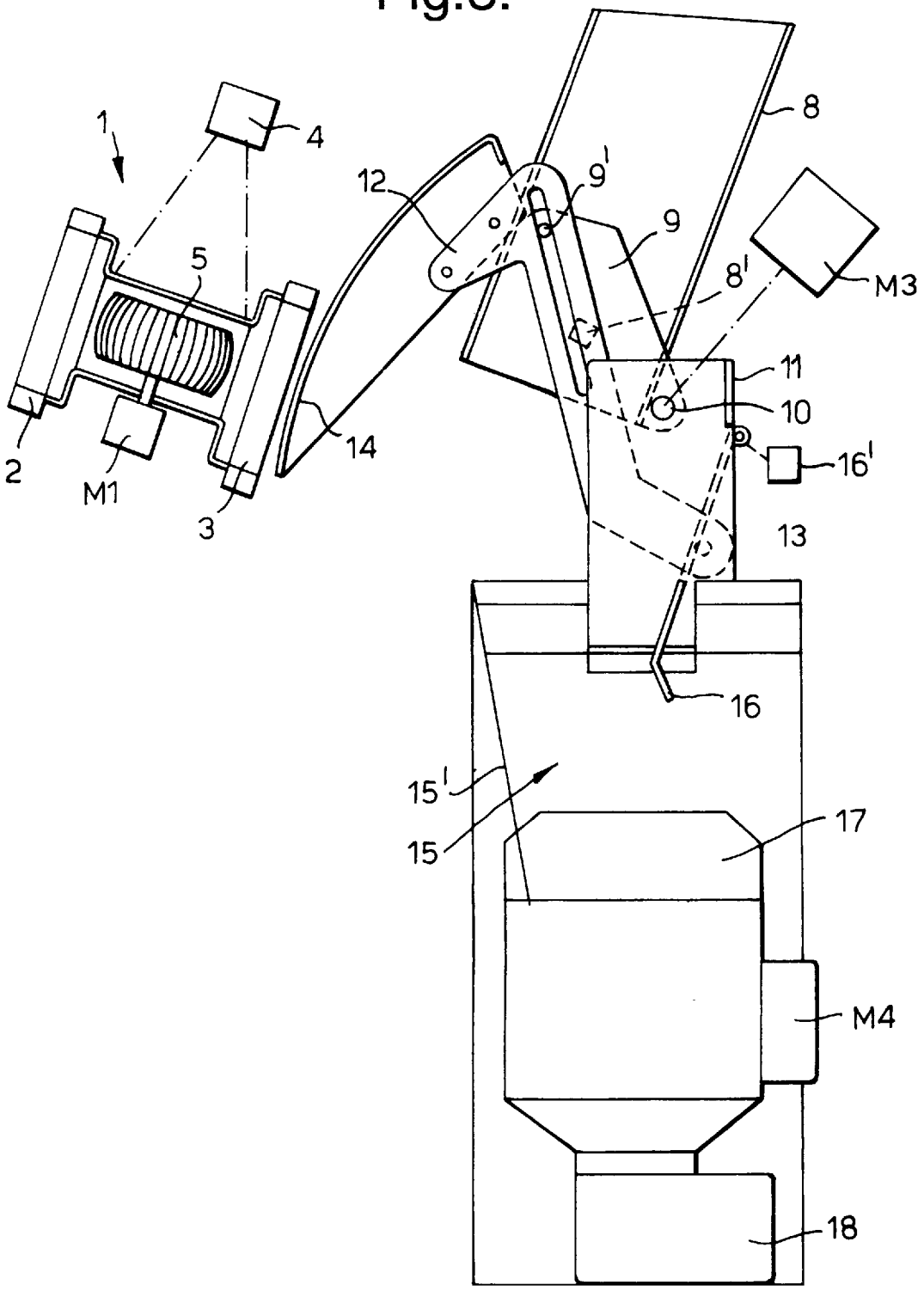
FIG. 3 shows the apparatus according to the invention in a typical service and/or cleaning position.

Impelling means 5, 6 in the form of wheels which are elastically yielding and having good friction coefficient, plus respective motors M1 and M2, are provided at the central portion of the first section to urge a can 21 in a first direction A through the first can guide and out via the second end, or to return a non-accepted can 21 to the machine user in a second, opposite direction B via the first end. In FIGS. 1–3, the first end is indicated by means of the reference numeral 1', the second end by means of 1", and the said central portion by means of 1'".

As shown in FIG. 5, a control unit 19 is connected to the metal detector 2, 3. Furthermore, the control unit 19 is connected to the reader 4. The control unit 19 also actuates the motors M1, M2 for operation of the wheels 5, 6. The control unit 19 is designed to determine whether data, such as bar code data retrieved from the reader, indicate that said characteristics are readable and hence the can is acceptable, or that said characteristics are readable but the can is not acceptable, or that said characteristics are not readable and hence the can thus far is not acceptable. As a consequence of one of said indications, the control unit 19 will be capable of actuating said impelling means 5, 6, M1, M2 in order to move the can in one direction A or the other B.

The actual operation of the apparatus will be explained in detail later on in the description.

The apparatus also consists of a second section 7 which has a blocking body 14 to prevent articles other than cans accepted by the control unit 19 from being transported from the first section 1 to the second section 2. In the most preferred embodiment, as shown in FIGS. 1–3, the blocking body 14 consists of an arcuate face which can be moved past the can discharge opening 1" in the first section 1. As can be seen from the drawings, the second section 7 has a second can guide 8, typically a tube which at its insertion opening 8' is preferably bevelled. This allows a rotary motion of the second can guide 8 down towards the can discharge opening 1" of the first section 1. The second can guide 8 is mounted in a support frame 11 and, via a spindle 10 in its mounting point, is controllable by means of a motor M3 which can be actuated via a connection with the control unit 19, as can be seen in FIG. 5. The blocking body 14 is pivotally connected to a support frame 11 by means of an arm structure 12. Moreover, the blocking body 14, via the arm structure 12, forms a slide connection 9',12" with the second can guide 8. Of course, other mechanical connections between the blocking body 14 and the can guide 8 are also conceivable, e.g., an articulation, a rigid fastening, or a gear transmission. Optionally, it is conceivable to allow the body 14 to be capable of being controlled separately. The blocking body 14 will thus have a movement past the can discharge opening 1" in the first section 1 as a function of the controllable movement of the second can guide 8. When the second can guide 8 is turned from a gently sloping position, as shown, e.g., in FIG. 2, to a substantially upright position, as shown in FIG. 1, the can guide 8 will thus be adjusted so that the received can 21 will be urged by means of gravity into a third can guide 15, which includes a fixed slanting wall 15'. An overload sensor plate 16 is pivotally secured to, e.g., the support frame 11. The plate 16 is spring-loaded and is operatively connected to an overload switch 16'. The switch 16' is connected to the control unit 19. When a can weighing too much, e.g., because it contains liquid, is inserted, the plate 16 will be moved against the elastic force effects, and the switch 16' will be activated, whereby the reverse vending machine is stopped by the control unit 19 and an alarm is emitted to a signalling means 22. The can must be removed manually, e.g., by bringing the guide 8 into the service position as shown in FIG. 3. During this operation the third guide 15 can be blocked manually so that the excessively heavy can does not fall down towards the compactor (which is not in operation).

At the outlet of the third can guide 15,16 there is provided a can compactor or can shredder 17 driven by a motor M4. At the exit 18 from the compactor compacted cans or shredded cans are fed to an appropriate receptacle means (not shown).

In the position of the apparatus as shown in FIG. 3, the second section 7 with blocking body 14 and the second guide 8 are in a typical service and/or cleaning position. A can 21 is inserted by the machine user into the first section 1 via an insertion opening 1'. The reader 4 will immediately search for a particular characteristic of the can which is designatory of the can's deposit value and returnability, if any. A characteristic of this kind according to a preferred embodiment of the invention is a bar code provided on a small area of the can. This bar code may alternatively form a part of a special decoration or be composed of other typical, easily recognisable characteristics. If the characteristic is a bar code, it will be known that bar codes are most often found on a limited area of the periphery of the can. If the bar code panel faces away from the optical reader, i.e., is not found within its sensing field, the control unit 19, on the basis of non-readable characteristics, will return the can to the user in that the motors M1 and M2 are actuated to move the can in the direction of the arrow B. The machine user will then be asked to turn the can about its axis so that the bar code faces upwards and can be viewed by the reader 4 when the can is reinserted into the first section 1 by the machine user. If the can is then deemed to be acceptable by the control unit 19 on the basis of the bar codes that are read, the wheels 5 and 6 with the aid of the motor M1 and M2 will feed the can all the way up to the can discharge opening 1". The can which is now inside section 1 is thus an accepted can for which, for example, a deposit refund will be made. If the user were now to attempt to pull the can wholly or partly out of section 1 against the action of the wheels 5 and 6, the metal detector 3 would sense a change of state which would be registered by the control unit, whereby registered refundable deposit for the can would be deleted in consequence of attempted swindle.

The blocking body 14 is essential as it prevents a can 21 from being able to pass out of section 1 without being registered by the reader 4 and accepted by the control unit 19. The blocking body 14 will also prevent other articles (non-registrable) from being sent through section 1. The blocking body 14 will be in place constantly until the second can guide 8 comes into position. As will be seen in FIG. 2, the slide connection 9',12', when the second can guide 8' is positioned with it axis through the first section 1, will cause the blocking body to be located immediately below the entrance to the second can guide 8. In this position, the can which has been accepted will be discharged from the first section 1 in that the control unit 19 actuates the motors M1 and M2 to turn the wheels 5 and 6 so that the can moves in direction A and so that the can 21 thus end-first slides down into contact with sensor plate 16. It will be appreciated immediately that the second guide 8 has an inclination, whilst its discharge opening is blocked by the plate 16, so that for the time being the can 21 will not advance further.

The second guide 8 is attached to a mounting 9 which is connected to a spindle 10 which is pivotally mounted in a support bracket 11. The spindle 10 is mechanically connected to a motor M3 which can be actuated from the control unit 19. The mounting 9 at the opposite end thereof is provided with a pin 9' which is slideable in a guide 12' in the arm structure 12 which supports the blocking body 14.

When the motor M3 on command from the control unit 19 moves the can guide 8, the arm structure 12 will turn about a point of rotation 13 on the support frame 11 at the same time as the pin 9' moves along the groove 12' in the arm structure 12, said pin 9' and groove 12' thus forming the previously mentioned slide connection. A controlled movement of the blocking body 14 is thus achieved whilst the necessary movements of the can guide 8 are effectuated.

When the motor M3 is actuated, the can guide 8 will rotate into an upright position, as shown in FIG. 3. Owing to the slide connection 9', 12', the blocking body will simultaneously move upwards and block the exit from the first section 1. At the same time, the can 21 which was just lying in the can guide 8 will be released therefrom by means of gravity and will be fed down into the compactor or shredder 17 which is operated by the motor M4. The motor M4 may optionally be turned on and off by the control unit 19 or may be continuously operational. As thus shown and described, the present invention exhibits a mechanically simple structure which is operationally safe and which in a simple manner prevents the reverse vending machine from being swindled. By virtue of the fact that the first section 1 operates with two metal detectors 2, 3 several advantages are obtained. As previously mentioned, attempts to withdraw an already accepted can wholly or partly out of the section 1 in direction B in order thereby to attempt to swindle the reverse vending machine will cause the counter to be reset at zero or approved deposit refunds to be annulled. The reel 3 also has a considerable advantage, viz., that it indicates when the can 21 has exited the section 1 and has entered the section 7, which will be registered by the control unit 19, which then initiates the operation of the motor M3 in order to bring the can guide 8 into an emptying position as shown in FIG. 1. In order to register that the can guide 8 has received a can 21, a can sensor 8', e.g., of the IR type is provided. When the can 21 exits the guide 8, the sensor 8' will also register this. The sensor 8' is connected to the control unit 19.

There is also a considerable safety aspect about the blocking body 14, namely that the blocking body starts to function automatically the second the last edge of the can 21 has exited the section 1, in that the can guide 8 is then turned upwards and the blocking body covers the discharge opening 1".

The control unit 19 may also contain a microprocessor for computing accumulated deposit sums for the received return cans, and when the machine user has inserted his last can and this has been approved, a printer 20 will provide the machine user with a receipt for received cans and accumulated return deposits due. The user can then take this receipt and exchange it for cash.

Having described my invention, I claim:

1. A reverse vending machine for empty cans, wherein a can which is delivered by a machine user is inspected in a first section of the machine with regard to special characteristics, where the first section consists of a first can guide having a first end for can insertion, a second end for can discharge and a partially open central portion, a first metal detector proximate to the first end, and a second metal detector proximate to the second end, and where impelling means are provided in addition to the first can guide to urge a can in a first direction therethrough and out via the second end, or return a non-accepted can to the machine user in a second, opposite direction via the first end, as a non-accepted can is returned to the machine user, whilst an accepted can is fed to a second section for discharge into a receptacle means, comprising;

a partially open central portion in the first can guide, between the first end and the second end thereof, an optical reader provided at a radial distance from said central portion its sensing field covering at least a part of said central portion, and reader reading characteristics of the can, a control unit connected to the metal detectors, the optical reader, and said impelling means, the control unit being designed to determine whether collected data indicate that:

said characteristics are readable and the can is acceptable, or said characteristics are readable, but the can is not acceptable, or said characteristics are not readable and the can is not acceptable, and as a consequence of such indication is designed to actuate said impelling means to move the can in one direction or the other, and that the second section being equipped with a blocking body to prevent articles other than cans accepted by the control unit from being transported from the first section to the second section.

2. An apparatus as disclosed in claim 1, wherein the blocking body is made of an arcuate face which is moveable past the can discharge opening in the first section.

3. An apparatus as disclosed in claim 1, wherein the second section has a second can guide, which is pivotally mounted in a support frame and, via a spindle in the mounting point, is controllable by means of a motor which can be actuated from the control unit.

4. An apparatus as disclosed in claim 3, wherein the blocking body is mechanically connected to the second can guide.

5. An apparatus as disclosed in claim 3, wherein the blocking body is pivotally connected to the support frame by means of an arm structure, and wherein the blocking body, also via the arm structure , forms a slide connection with the second can guide, the blocking body thereby given movement past the can discharge opening the first section as a function of the controllable movement of the second can guide.

6. An apparatus as disclosed in claim 3, wherein the second can guide is designed to move the received can by gravity into a third can guide when the second can guide is turned from a gently sloping position to a substantially upright position.

7. An apparatus as disclosed in claim 6, wherein a can compactor is provided at the outlet of the third can guide.

8. An apparatus as disclosed in claim 1, wherein said impelling means are provided at said central portion of the first can guide.

9. An apparatus as disclosed in claim 6 wherein a shredder is provided at the outlet of the third can guide.

10. An apparatus as disclosed in claim 1, wherein the characteristics of the can are in the form of a bar code applied thereon.

* * * * *